United States Patent [19]

Higgins

[11] 4,072,024

[45] Feb. 7, 1978

[54] RECOVERY OF AMMONIA FROM UNDERGROUND STORAGE

[75] Inventor: John Tyson Higgins, Trail, Canada

[73] Assignee: Cominco Ltd., Vancouver, Canada

[21] Appl. No.: 731,243

[22] Filed: Oct. 12, 1976

[51] Int. Cl.[2] ..... F17C 9/02

[52] U.S. Cl. ..... 62/50; 61/.5; 62/54; 222/3; 222/146 H

[58] Field of Search ..... 62/48, 50, 51, 54; 61/.5; 222/146 H, 146 HS, 3

[56] References Cited

U.S. PATENT DOCUMENTS

| | | | |
|---|---|---|---|
| 1,638,434 | 8/1927 | Curme, Jr. et al. | 62/50 |
| 2,251,796 | 8/1941 | Howard | 62/50 |
| 2,522,026 | 9/1950 | Evans | 62/48 |
| 2,713,775 | 7/1955 | Cottle | 62/48 |
| 2,732,334 | 1/1956 | Pollock | 62/48 |
| 2,859,594 | 11/1958 | Peck | 62/50 |
| 2,878,165 | 3/1959 | Cottle | 62/48 |
| 2,901,403 | 8/1959 | Adams et al. | 61/.5 |

*Primary Examiner*—Ronald C. Capossela
*Attorney, Agent, or Firm*—Arne I. Fors

[57] ABSTRACT

A process for recovering gaseous ammonia from liquefied ammonia stored in an underground cavern includes heating gaseous ammonia to a temperature below that at which decomposition occurs and feeding it into the liquefied ammonia in the cavern. The release of the heated gaseous ammonia in the liquefied ammonia causes conversion of some of the liquid into gaseous form, and gaseous ammonia so formed is withdrawn from the cavern.

6 Claims, 1 Drawing Figure

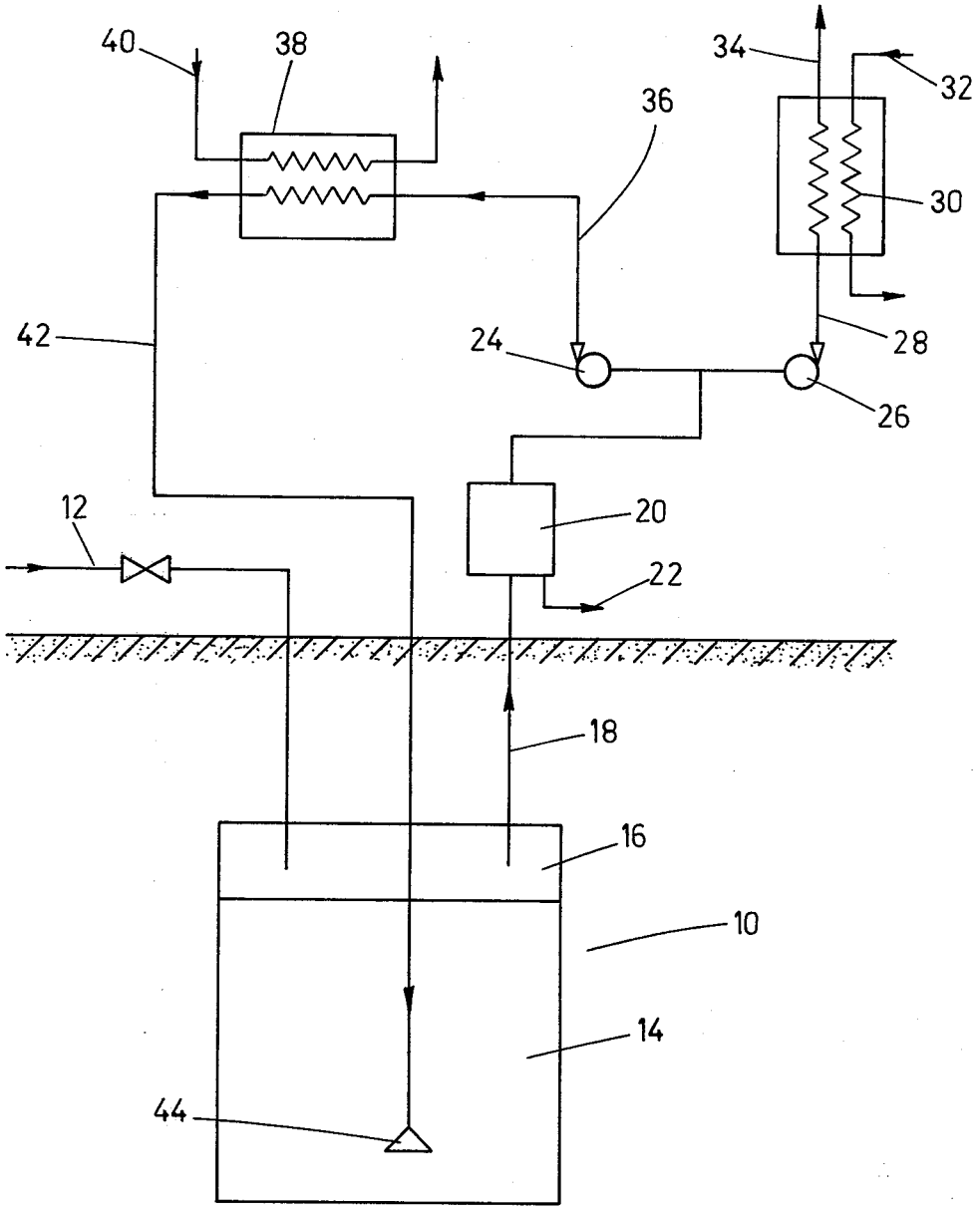
40
38
34
32
36
30
42
24
28
26
12
20
22
18
16
10
14
44

RECOVERY OF AMMONIA FROM UNDERGROUND STORAGE

BACKGROUND OF THE INVENTION

This invention relates to the recovery of ammonia from underground storage caverns, for example caverns made in natural salt deposits.

Because of the seasonal demand for ammonia and ammonia products, for example in the fertilizer industry, manufacturing capacity during off-seasons exceeds the rate of consumption. It is economic to produce excess ammonia at these times and store this excess for use during times of peak demand. Although underground storage of ammonia is known, this method of storage has not generally gained favour over use of above ground storage tanks, some of which are large enough to hold 40,000 tons of ammonia. Although many precautions are taken to provide safe above ground storage of ammonia, such as storage in remote areas on stable ground, there is a hazard of accidental release of large quantities of ammonia to the atmosphere. Underground storage reduces this hazard substantially. However, known processes for the recovery of ammonia from underground caverns have disadvantages in their need of elaborate heat exchange and gas purification means. Some of the problems arise because the underground caverns are made from natural salt deposits and the salt contaminates the ammonia, particularly when it is withdrawn from the cavern in liquid form.

In U.S. Pat. No. 2,732,334 (Pollock), gaseous ammonia is withdrawn from the region above the surface of liquefied ammonia stored in an underground salt cavern. The withdrawn gaseous ammonia is compressed without liquefying, and is returned to the cavern where it is passed through a heat exchange conduit immersed in the liquefied ammonia. The gaseous ammonia condenses in the immersed conduit, giving up heat which evaporates some of the stored liquid. The condensed ammonia is then pumped by a submerged pump from the immersed conduit to an above ground outlet product line. This process therefore requires the presence of a heat exchange conduit and a pump submerged in the liquefied ammonia in the cavern.

In one embodiment of the process described in U.S. Pat. No. 2,713,775 (Cottle), an inert liquid, which is denser than ammonia and has a higher boiling point, such as pentane, is added to a salt cavern containing liquefied ammonia to cover heat exchanger piping and a pump. Ammonia gas is removed from above the liquid ammonia, compressed and passed through the submerged piping. Heat given up to the pentane by the ammonia gas is, in turn, given up to the layer of liquid ammonia above it, some of which is thereby evaporated. The ammonia gas in the submerged piping condenses as it loses heat to the pentane and is pumped to the surface, where it is separated from any entrained pentane liquid. In another embodiment, liquid ammonia is removed from the cavern and passed through an evaporator in which a pentane layer is used to separate dissolved salt. The complications involved by the use of an inert liquid such as pentane are readily apparent.

In the process described in U.S. Pat. No. 2,878,165 (Cottle), ammonia gas is pumped into a salt cavern to move salt-containing liquid ammonia into an above ground purification system where salt is separated. U.S. Pat. No. 2,901,403 (Adams) provides a process in which an inert gas, such as off-gas from ammonia synthesis, is introduced into a salt cavern containing liquid ammonia and dissolved salt with sufficient force to lift the liquid into an above ground separator, where the inert gas is separated and recycled. Ammonia is then distilled from the salt solution. Again, the complicated nature of these processes is readily apparent.

It is therefore an object of the invention to provide a process for recovering ammonia from an underground cavern, such as a salt cavern, in a relatively uncontaminated state and with a less complicated withdrawal system than those previously known.

SUMMARY OF THE INVENTION

According to the present invention, gaseous ammonia is heated to a temperature below that at which decomposition occurs. The heated gaseous ammonia is then fed into the liquefied ammonia in the cavern and released in the liquefied ammonia to cause conversion of some of the liquid ammonia into gaseous form. Ammonia gas thus formed is then withdrawn from the cavern. Such a process avoids the complications of the prior art and, at the same time, enables ammonia gas of reasonable purity to be recovered from a cavern such as a salt cavern.

The ammonia gas may be heated in any convenient manner, for example by a simple gas-fired heater or by passage through a heat exchanger provided with cycling heated fluid. The heated gaseous ammonia is preferably sparged into the liquid amonia near the centre of the cavern, away from the walls, and at sufficient depth to get good heat exchange by circulating the liquid ammonia.

Ammonia gas withdrawn from the cavern is preferably passed through a mist eliminator which removes entrained liquid droplets, such as droplets of ammonia-salt solution if a salt cavern is used. Better droplet removal is obtained if a low gas velocity is maintained in the mist eliminator. Ammonia gas containing less than 100 parts per million chloride may be obtained in this way. A fine wire mesh, for example, stainless steel, mist eliminator may be used. Such gas purity is acceptable for direct application of the ammonia to soil as a fertilizer or in such chemical processes as the manufacture of urea. Some further purification may be necessary on the entry of the ammonia into a plant for the synthesis of nitric acid.

Advantageously, a portion of the ammonia gas withdrawn from the cavern is supplied to the heating step, and another portion of the ammonia gas withdrawn from the cavern is utilized elsewhere for whatever purpose it is required.

In the heating step, the gaseous ammonia is preferably heated to a temperature between about 260° C. and about 460° C.

BRIEF DESCRIPTION OF THE DRAWING

One embodiment of the present invention will now be described, by way of example, with reference to the accompanying drawing, which shows a schematic view of an underground salt cavern in which ammonia is stored, together with means for recovering the ammonia therefrom.

DESCRIPTION OF THE PREFERRED EMBODIMENT

Referring to the accompanying drawing, a sealed underground salt cavern 10 is filled by means of supply pipe 12 with liquid ammonia 14 to a depth preferably not exceeding 200 feet, leaving a space 16 above the liquid ammonia for accumulation of gaseous ammonia. Stored ammonia 14 is kept at about 116 psig pressure at a ground temperature of about 18° C. Gaseous ammonia is withdrawn through pipe 18, which passes through mist elminator 20 for removal of entrained droplets of ammonia-salt solution, accumulated liquid being withdrawn through drain 22. A recycle portion passes to pump 24, while a product portion passes to pump 26. The product portion passes through pipe 28 to a cooler 30, where cooling water entering through inlet 32 lowers the temperature from about 65° C. to about 38° C., and thence passes through line 34 to a consuming operation.

The recycle portion passes through pipe 36 at about 212 psig pressure to heat exchanger 38, in which cycling, temperature-controlled fluid entering through inlet 40 heats the gaseous ammonia to a temperature below that at which decomposition occurs. Heated gaseous ammonia is then returned through pipe 42 to the storage cavern where it is released in the liquid ammonia 14 from a sparger 44. The sparger 44 is preferably located near the centre of the cavern, away from its side walls, to minimize side wall erosion as the gaseous ammonia is mixed with the fluid ammonia, the sparger 44 being immersed at a depth that permits circulation of enough of the liquid to ensure good heat exchange. The gaseous ammonia thus produced rises to space 16 for withdrawal through pipe 18.

Depending on the temperature of the heated gaseous ammonia entering the cavern through pipe 42, about 30 to 45 per cent of the evaporated ammonia can be recovered as product,. In one specific example, with gas heated to 427° C., 234,000 pounds per hour of gaseous ammonia were divided into a recovery stream of 100,000 pounds per hour or 43 per cent of the evaporated ammonia, and a recycle stream of 134,000 pounds per hour or 57 per cent of the evaporated ammonia. In another specific example, with heating to 296° C., 300,000 pounds per hour of gaseous ammonia were divided into recovery and recycle streams of 100,000 and 200,000 pounds per hour or 33 per cent and 67 per cent, respectively. A simple mist eliminator in which droplets were retained on wire gauze decreased entrainment of chloride in the gaseous ammonia to less than 100 parts per million.

The described embodiment and specific examples adequately illustrate the simplicity and efficiency of the invention. Various other embodiments within the scope of the invention will be apparent to the man skilled in the art, the scope of the invention being defined in the appended claims.

What I claim as new and desire to protect by Letters Patent of the United States is:

1. A process for recovering gaseous ammonia from liquefied ammonia stored in an underground cavern, comprising heating gaseous ammonia to a temperature below that at which decomposition occurs, feeding said heated gaseous ammonia into the liquefied ammonia in the cavern and releasing the heated gaseous ammonia in said liquefied ammonia to cause conversion of some of the liquid into gaseous form, and withdrawing gaseous ammonia from the cavern.

2. A process according to claim 1 wherein a portion of the ammonia gas withdrawn from the cavern is supplied to the heating step and another portion of the ammonia gas withdrawn from the cavern is utilized elsewhere.

3. A process according to claim 1 wherein the ammonia gas withdrawn from the cavern is passed through a mist eliminator to separate entrained liquid droplets therefrom.

4. A process according to claim 1 wherein the gaseous ammonia is heated to a temperature between about 260° C. and about 460° C.

5. A process for recovering gaseous ammonia from liquefied ammonia stored in an underground salt cavern, comprising heating gaseous ammonia to a temperature below that at which decomposition occurs, feeding said heated gaseous ammonia into the liquefied ammonia in the cavern and releasing the heated gaseous ammonia in said liquefied ammonia to cause conversion of some of the liquefied ammonia into gaseous form, withdrawing gaseous ammonia through a mist eliminator to separate entrained liquid droplets containing dissolved salt therefrom, supplying a portion of said withdrawn ammonia gas to the heating step, and utilizing another portion of the withdrawn ammonia gas elsewhere.

6. A process according to claim 5 wherein the gaseous ammonia is heated to a temperature between about 260° C. and about 460° C.

* * * * *